US010303121B2

(12) United States Patent
Fukuda et al.

(10) Patent No.: US 10,303,121 B2
(45) Date of Patent: May 28, 2019

(54) POWER TRANSMISSION BODY OF TIMEPIECE AND METHOD OF MANUFACTURING POWER TRANSMISSION BODY OF TIMEPIECE

(71) Applicant: CITIZEN WATCH CO., LTD., Nishitokyo-shi, Tokyo (JP)

(72) Inventors: Tadahiro Fukuda, Tokorozawa (JP); Shinpei Fukaya, Tokorozawa (JP); Yoshiki Ono, Tokyo (JP)

(73) Assignee: CITIZEN WATCH CO., LTD., Nishitokyo-Shi, Tokyo (JP)

( * ) Notice: Subject to any disclaimer, the term of this patent is extended or adjusted under 35 U.S.C. 154(b) by 0 days.

(21) Appl. No.: 15/555,648

(22) PCT Filed: Mar. 1, 2016

(86) PCT No.: PCT/JP2016/056289
§ 371 (c)(1),
(2) Date: Sep. 5, 2017

(87) PCT Pub. No.: WO2016/143612
PCT Pub. Date: Sep. 15, 2016

(65) Prior Publication Data

US 2018/0046142 A1 Feb. 15, 2018

(30) Foreign Application Priority Data

Mar. 11, 2015 (JP) ..... 2015-048629

(51) Int. Cl.
*G04B 13/02* (2006.01)
*G04B 1/16* (2006.01)

(52) U.S. Cl.
CPC ..... *G04B 13/026* (2013.01); *G04B 1/16* (2013.01); *G04B 13/02* (2013.01); *G04B 13/022* (2013.01)

(58) Field of Classification Search
CPC ..... G04B 13/00; G04B 13/02; G04B 13/026
See application file for complete search history.

(56) References Cited

U.S. PATENT DOCUMENTS 5,272,930 A 12/1993 Nakamura et al.
6,422,348 B1 7/2002 Jujo et al.
(Continued)

FOREIGN PATENT DOCUMENTS

CH 699476 A2 3/2010
CN 1288530 A 3/2001
(Continued)

OTHER PUBLICATIONS

International Search Report issued in International Application No. PCT/JP2016/056289, dated May 31, 2016.
(Continued)

*Primary Examiner* — Edwin A. Leon
*Assistant Examiner* — Jason M Collins
(74) *Attorney, Agent, or Firm* — Knobbe, Martens, Olson & Bear LLP

(57) ABSTRACT

A power transmission body of a timepiece in which a fixed portion between an arbor and a power transmission member is hardly damaged is provided without increasing the number of components. A transmission wheel (one example of power transmission body) includes a gear and a pinion (one example of arbor). A hole formed in a center portion of the gear includes a regular octagon with a rotation center as a center. An insertion portion formed in the pinion includes a gear-like portion including a tooth bottom and a tooth tip. The hole includes eight portions that are positioned in a circumference direction about the rotation center and contact the insertion portion. The hole includes a portion that is positioned in front of the eight portions in a clockwise direction (specific rotation direction) about the rotation
(Continued)

center and has a distance from the rotation center longer than a distance from the rotation center to each of the eight portions.

7 Claims, 11 Drawing Sheets

(56) References Cited

U.S. PATENT DOCUMENTS

| | | | |
|---|---|---|---|
| 7,572,050 | B2 | 8/2009 | Bitterli et al. |
| 8,206,029 | B2 | 6/2012 | Vaucher et al. |
| 8,277,117 | B2 | 10/2012 | Verardo et al. |
| 2006/0187768 | A1 | 8/2006 | Murazumi |
| 2017/0185040 | A1 | 6/2017 | Mertenat |

FOREIGN PATENT DOCUMENTS

| | | | |
|---|---|---|---|
| CN | 101390022 | A | 3/2009 |
| CN | 104122786 | A | 10/2014 |
| DE | 10049975 | A1 | 5/2002 |
| EP | 1 046 964 | A1 | 10/2000 |
| EP | 1 826 634 | A1 | 8/2007 |
| EP | 2957963 | A1 | 12/2015 |
| GB | 2256468 | | 12/1992 |
| JP | H01-172607 | | 7/1989 |
| JP | H11-194177 | | 7/1999 |
| JP | 2003-222682 | A | 8/2003 |
| JP | 2009-528524 | | 8/2009 |
| JP | 2012-229723 | | 11/2012 |
| JP | 5175523 | | 4/2013 |
| JP | 5189612 | | 4/2013 |
| KR | 10-2008-0111446 | A | 12/2008 |

OTHER PUBLICATIONS

Written Opinion issued in International Application No. PCT/JP2016/056289, dated May 31, 2016.

Extended European Search Report; Application No. 16761582.2; dated Dec. 20, 2018; 8 pages.

Chinese Office Action dated Apr. 12, 2019; Chinese Application No. 201680011188.7; 13 pages total (with translation).

POWER TRANSMISSION BODY OF TIMEPIECE AND METHOD OF MANUFACTURING POWER TRANSMISSION BODY OF TIMEPIECE

CROSS-REFERENCE TO RELATED APPLICATIONS

This application is the U.S. National Phase under 35 U.S.C. § 371 of International Application No. PCT/JP2016/056289, filed on Mar. 1, 2016, which claims priority to Japanese Patent Application No. 2015-048629, filed on Mar. 11, 2015. The entire contents of these applications are incorporated herein by reference.

This invention relates to a power transmission body of a timepiece and a method of manufacturing the power transmission body of the timepiece.

BACKGROUND ART

In a timepiece, power generated by, for example, a mainspring or a motor is transferred to a hand through a wheel train to drive the hand. The wheel train is configured by engaging transmission wheels such as a second wheel and a third gear. In each transmission wheel, a gear and a pinion are coaxially integrated. Specifically, a hole into which the pinion is fitted is formed in the center of the gear, and the gear and the pinion are integrated by pressing the pinion into the hole of the gear along a shaft center direction. When both the gear and the pinion are made from metal, the peripheral portion of the hole of the gear and the pinion elastically deform. Therefore, it is possible to press the pinion into the hole.

In recent years, a gear made from a brittle material such as silicon has been tested so as to reduce its weight and simplify its shape. The brittle material may damage the gear when the pinion is pressed into the gear in the shaft center direction similar to the metal gear and pinion because the brittle material has an extremely small deformation volume. For this reason, a technique of fixing a pinion inserted into a hole has been proposed (see, e.g., Patent Literature 2). In this technique, a groove is formed outside the hole of a gear to reduce the thickness of the edge portion of the hole, and another component is fitted into the groove to locally deform the edge portion of the hole inwardly, so that the pinion inserted into the hole is fixed.

A technique of holding a shaft in a gear has been also proposed (see, e.g., Patent Literature 1). In this technique, a thin elastic structure extending toward an inside of a hole is formed in the gear, and the shaft is inserted in the shaft center direction with the elastic structure being elastically deformed, so that the shaft is held by a restoring force of the elastic structure.

PATENT LITERATURE

Patent Literature 1: JP5175523B
Patent Literature 2: JP5189612B

SUMMARY

However, the technique described in Patent Literature 1 has the following problem. As the technique described in Patent Literature 1 requires another component to be fitted into the groove, the number of components is increased and the manufacturing costs are increased, resulting in a complex manufacturing process such as additional step of fitting another component into the groove. This problem may occur not only in a transmission wheel configured by the combination of a gear and a pinion but also in an entire power transmission body configured by the combination of a power transmission member and an arbor to transfer power of anchors, for example.

The technique described in Patent Literature 2 has the following problem. As the long thin elastic structure made from the brittle material is used, the elastic structure may be easily damaged when the shaft is pressed. Such a problem may occur when the elastic structure is made from a material different from the brittle material. The present invention has been made in view of the above circumferences, and an object of the present invention is to provide a power transmission body of a timepiece in which a fixed portion between an arbor and a power transmission member is hardly damaged without increasing the number of components and a method of manufacturing the power transmission body of the timepiece.

Solution to Problem

One aspect of the present invention provides a power transmission body of a timepiece, including: a power transmission member provided with a hole in a center portion of the power transmission member and an arbor including an insertion portion fitted into the hole. The hole has distances from a rotation center to an inner edge, and the distances are different in accordance with angular positions about the rotation center. The insertion portion has distances from the rotation center to an outer edge, and the distances are different in accordance with angular positions about the rotation center. The hole includes two portions that are positioned in a circumference direction about the rotation center and contact the insertion portion, and a portion that is positioned in front of the two portions in a specific rotation direction about the rotation center and has a distance from the rotation center longer than a distance from the rotation center to each of the two portions.

Second aspect of the present invention provides a method of manufacturing a power transmission body of a timepiece. An arbor includes an insertion portion having distances from a rotation center to an outer edge, and the distances are different in accordance with angular positions about the rotation center. A power transmission member includes a hole having a contour, and the hole is larger than the insertion portion at a specific angular position about the rotation center. The contour includes at least two portions having a distance shorter than a maximum distance of the insertion portion at an angular position different from the specific angular position. The method includes: for connecting the arbor and the power transmission member, inserting the insertion portion in the hole at the specific angular position; and connecting the power transmission member and the arbor by rotating at least one of the power transmission member and the arbor relative to the other of the power transmission member and the arbor such that the insertion portion contact the hole at the two portions.

DETAILED DESCRIPTION

Hereinafter, a power transmission body of a timepiece and a method of manufacturing the power transmission body according to embodiments of the present invention are described with reference to the drawings.

Configuration of Transmission Wheel

Figure 1:
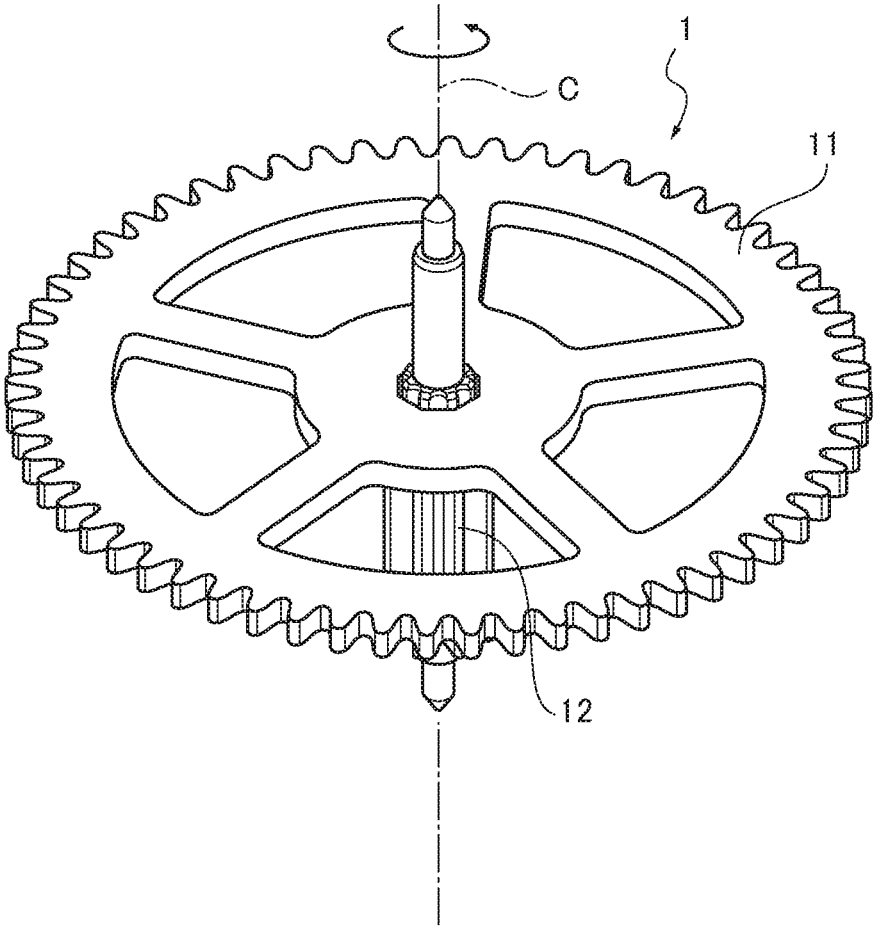
FIG. 1 is a perspective view illustrating a transmission wheel of a timepiece according to an embodiment of the present invention.
Figure 2:
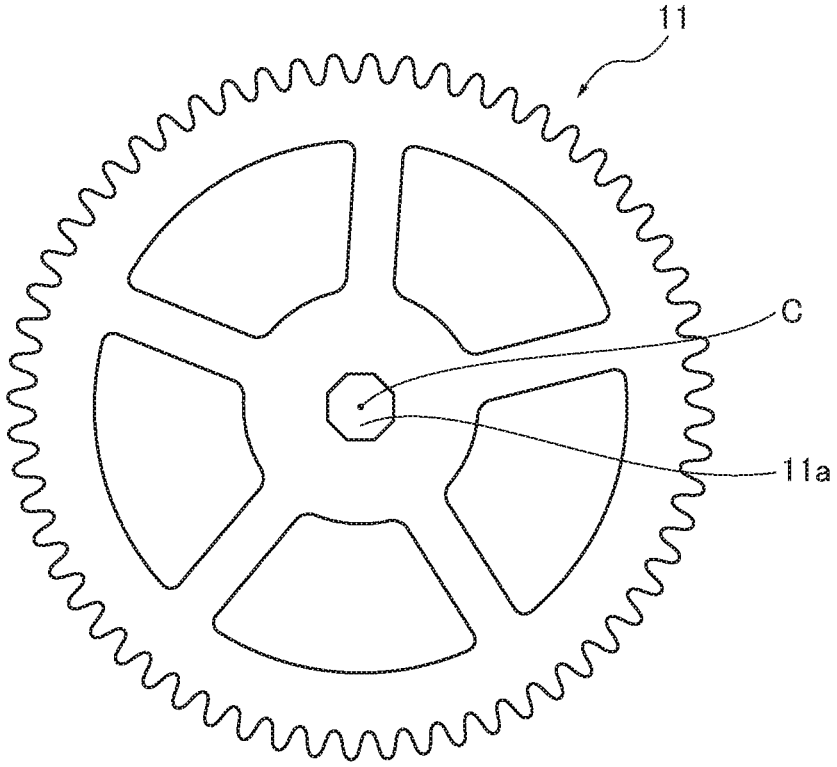
FIG. 2 is a plan view illustrating a gear in the transmission wheel in FIG. 1.
Figure 3:
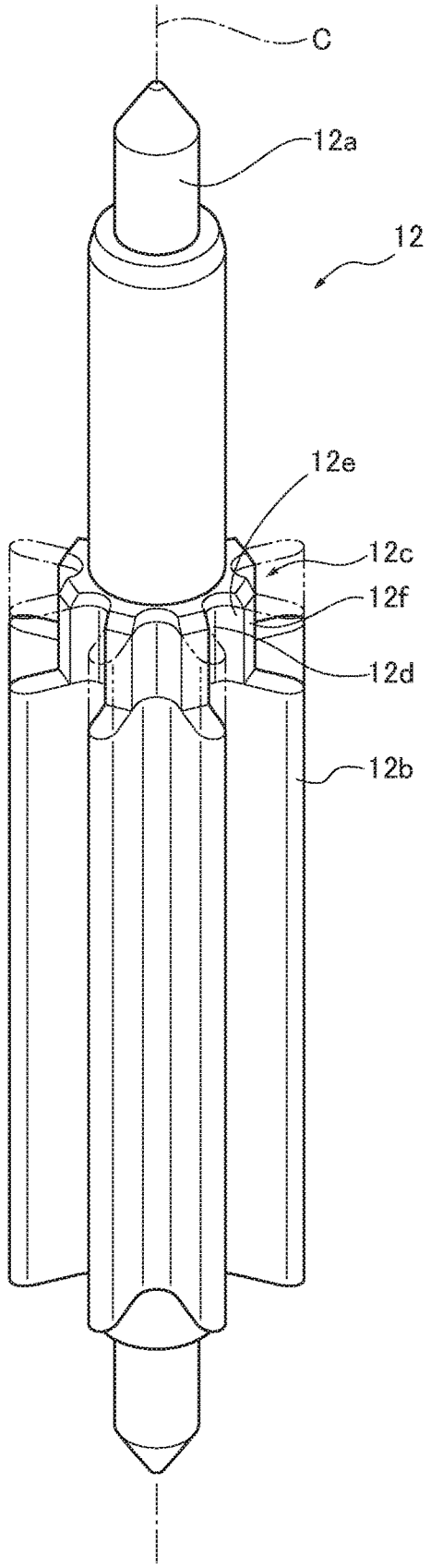
FIG. 3 is a perspective view illustrating a pinion in the transmission wheel in FIG. 1.

FIG. 1 is a perspective view illustrating a transmission wheel 1 of a timepiece according to the embodiment of the present invention. FIG. 2 is a plan view illustrating a gear 11 in the transmission wheel 1 of FIG. 1. FIG. 3 is a perspective view illustrating a pinion 12 in the transmission wheel 1 of FIG. 1. The pinion 12 illustrated in FIG. 3 is an enlarged pinion illustrated in FIG. 1.

The transmission wheel 1 (one example of power transmission body) is a gear device that sequentially transfers power of a wheel train in a mechanical timepiece, for example. The gear train includes a second wheel, a third wheel, a fourth wheel, and an escape wheel. As illustrated in FIG. 1, in the transmission wheel 1, the gear 11 (one example of power transmission member) having a relatively large diameter and the pinion 12 (one example of shaft center) having a small dimeter are integrated.

In this case, the gear 11 is made from a brittle material such as silicon, glass, and ceramics. Note that the gear 11 may be made from a material different from the brittle material. As illustrated in FIG. 2, the gear 11 is provided with a hole 11*a* in a center portion of the gear 11. The hole 11*a* is formed into a regular octagon, for example. The hole 11*a* has distances (radius) from a rotation center C to an inner edge. The distances differ in accordance with angular positions about the rotation center.

The pinion 12 is made from metal such as brass. As illustrated in FIG. 3, the pinion 12 includes a tenon 12*a* as a shaft, a gear portion 12*b*, and an insertion portion 12*c*. Top and bottom ends of the tenon 12*a* are supported by jewels provided in a base plate or a wheel train receiver. The pinion 12 is rotatable about the shaft center of the tenon 12*a* as the rotation center C. The gear portion 12*b* is a gear having eight teeth, for example, formed with the rotation center C as a center, and engages with a gear of another transmission wheel to transfer power.

The insertion portion 12*c* is formed by cutting off a portion of teeth of an upper portion of the gear portion 12*b* (illustrated by two-dot chain line in FIG. 3). The insertion portion 12*c* has a gear-like contour including tooth tips 12*f* each having a long distance from the rotation center C and tooth bottoms 12*d* each having a short distance from the rotation center C in accordance with angular positions about the rotation center C.

Figure 4A:
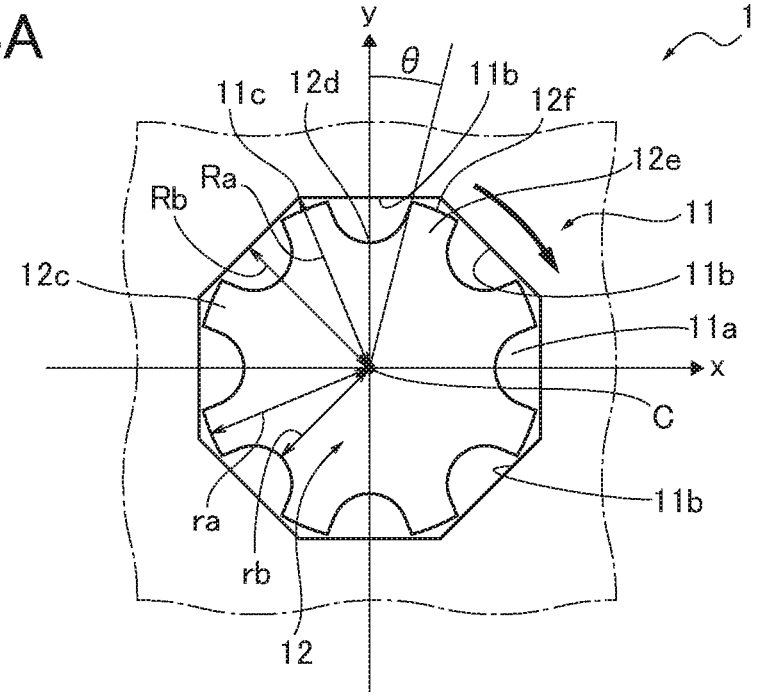
FIG. 4A is a plan view illustrating a relationship between a hole of the gear and an insertion portion of the pinion before the gear and the pinion are connected.
Figure 4B:
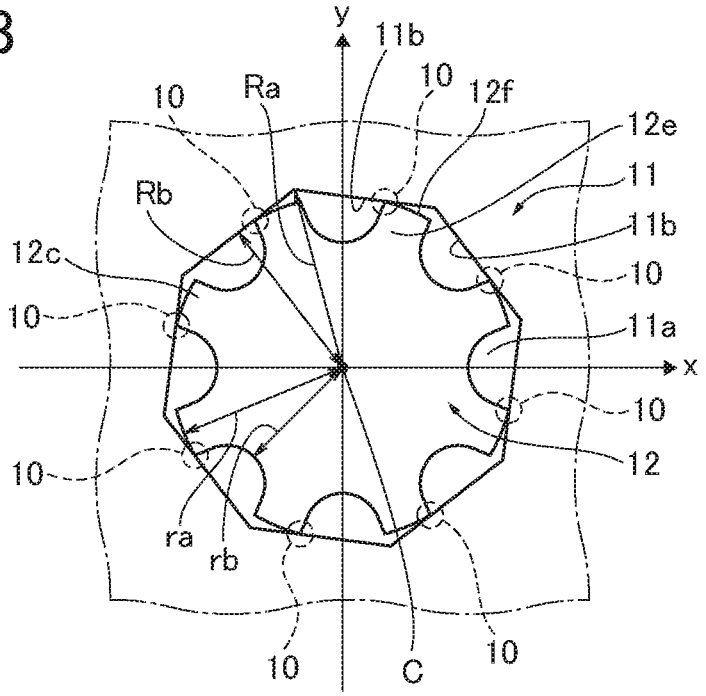
FIG. 4B is a plan view illustrating a relationship between the hole of the gear and the insertion portion of the pinion after the gear and the pinion are connected.

FIGS. 4A and 4B are plan views each illustrating the relationship between the hole 11*a* of the gear 11 and the insertion portion 12*c*. The insertion portion 12*c* is a gear-like portion having a distance (radius) from the rotation center C to the tooth tip 12*f* which is the outermost edge of the insertion portion 12*c*. The insertion portion 12*c* is formed by cutting off the outer portion of the teeth of the gear portion 12*b*. Thus, the gear-like portion of the insertion portion 12*c* has the same sectional contour as a portion of the gear portion 12*b* from the rotation center C to the radius ra.

As illustrated in FIGS. 4A and 4B, a distance (radius) rb from the rotation center C to the outer edge of the tooth bottom 12*d* of the gear-like portion of the insertion portion 12*c* differs from a distance (radius) ra from the rotation center C to the outer edge of the tooth tip 12*f* of the gear-like portion of the insertion portion 12*c*. The distances have the relationship of the distance ra>the distance rb.

As illustrated FIG. 2, the hole 11*a* of the gear 11 is formed into a regular octagon with the rotation center C of the gear 11 as a center. The shape of the hole 11*a* includes vertexes 11*c*. The number of vertexes 11*c* coincides with the number of teeth 12*e* of the gear-like portion of the insertion portion 12*c*. The hole 11*a* is formed into a regular polygon in which a circle having a radius Rb from the rotation center C inscribes each side 11*b*. In this embodiment, as the insertion portion 12*c* has the eight teeth 12*e*, the hole 11*a* is formed into the regular octagon. The distance (radius) from the rotation center C to the vertex 11*c* of the regular octagon is Ra.

As illustrated in FIGS. 4A and 4B, as the hole 11*a* has the regular octagon with the rotation center C as a center, the distance Ra from the rotation center C to the vertex 11*c* differs from the distance Rb from the rotation center C to the side 11*b*. The distances have the relationship of the distance Ra>the distance Rb.

As illustrated in FIG. 4A, in the transmission wheel 1 according to the present embodiment, the distance ra of the insertion portion 12*c*, the distances Ra, Rb of the hole 11*a*, and an angle θ satisfy the following an inequation where the angle θ is an angle between a line connecting the rotation center C and a center of the tooth bottom 12*d* and a line connecting the rotation center C and the portion of the tooth tip 12*f* adjacent to the center of the tooth bottom 12*d*.

$$Ra<ra<Rb/(\cos\theta)\leq Ra$$

Namely, as illustrated in FIG. 4A, the right condition (ra<Rb/(cos θ)) shows that the length (distance ra) from the rotation center C to the tooth tip 12*f* is shorter than the length (distance Rb/(cos θ)) from the rotation center C to each side 11*b* at the positon of the angle θ when the tooth tip 12*f* of the insertion portion 12*c* is arranged at the position of the angle θ from the center part (the part where the inscribed circle of the hole 11*a* with the radius Ra contacts) of each side 11*b* of the regular octagon hole 11*a*.

When the distance from the rotation center C to each of the vertexes 11*c* of the regular octagon is the distance Ra, the length (distance Rb/(cos θ)) from the rotation center C to each side 11*b* at the angular position of the angle θ is shorter than the distance Ra. Thus, with this arrangement, a space is formed between the insertion portion 12*c* and the hole 11*a* over the entire circumference about the rotation center C, and the insertion portion 12*c* does not contact the hole 11*a* over the entire circumference.

As described above, when the hole 11*a* has the regular octagon, the distance Ra from the rotation center C to the vertex 11*c* is obviously longer than the length (Rb/(cos θ)) from the rotation center C to each side 11*b* at the positon of the angle θ. However, the distance Ra from the rotation center C to the vertex 11*c* may be equal to the length (Rb/(cos θ)) from the rotation center C to each side 11*b* at the positon of the angle θ according to the shape of the hole 11*a* as long as the insertion portion 12*c* does not contact the hole 11*a* over the entire circumference.

The left condition of the above inequation shows that the distance ra from the rotation center C to the tooth tip 12*f* of the insertion portion 12*c* is larger than the radius Rb of the inscribed circle of the hole 11*a* of the regular octagon. By rotating the gear 11 from the non-contact state over the entire circumference as illustrated in FIG. 4A or rotating the pinion 12 in the opposite direction (counterclockwise direction), the eight tooth tips 12*f* of the insertion portion 12*c* contact the sides 11*b* of the holes 11*a* corresponding to the tooth tips 12*f* in front of the center parts (the parts where the inscribed circle of the hole 11*a* with the radius Rb contacts) of the sides 11*b*, respectively.

In a step of manufacturing the transmission wheel 1 with the combination of the gear 11 and the pinion 12, the insertion portion 12*c* of the pinion 12 is inserted into the hole 11*a* of the gear 11 with the arrangement (specific angle) illustrated in FIG. 4A in which the insertion portion 12*c* does not contact the hole 11*a* over the entire circumference.

After that, by rotating the gear 11 in the arrow direction (clockwise direction) or rotating the pinion 12 in the direction (counterclockwise direction) opposite to the arrow direction, the gear 11 contacts the pinion 12 at the eight portions in the circumference direction about the rotation center C as illustrated in FIG. 4B. The transmission wheel 1 of the present embodiment is completed by the connection between the gear 11 and the pinion 12 at the eight portions with the friction force.

In the completed transmission wheel 1 of the present embodiment as illustrated in FIG. 4B, an adhesive agent 10 is further applied to the contact portion between the gear 11 and the pinion 12, so that the connection between the gear 11 and the pinion 12 is strengthened. It is preferable to use an adhesive agent that cures at a normal temperature. It is preferable to use, for example, a normal temperature curing epoxy adhesive agent and an ultraviolet curing adhesive agent. It is not always necessary to apply the adhesive agent 10. The connection between the gear 11 and the pinion 12 may be strengthened with a method except the application of the adhesive agent 10.

In the completed transmission wheel 1 as illustrated in FIG. 4B, the hole 11*a* includes eight portions that are positioned in the circumference direction about the rotation center C and contact the insertion portion 12*c*, and a portion (e.g., vertex 11*c*) that is positioned in front of the eight portions in the clockwise direction (specific rotation direction) about the rotation center C and has a distance (e.g., distance Ra) from the rotation center C longer than a distance (distance Rb) from the rotation center C to each of the eight portions.

Operation of Transmission Wheel

According to the transmission wheel 1 of the present embodiment as described above, since the distance from the rotation center C to the portion of the hole 11*a* in front of the eight portions of the holes 11*a* is longer than the distance from the rotation center C to each of the eight portions of the hole 11*a*, the insertion portion 12*c* does not contact the hole 11*a* over the entire circumference with the gear 11 being rotated in the counterclockwise direction relative to the pinion 12 (arrangement in FIG. 4A).

Therefore, with the non-contact state of the hole 11*a* and the insertion portion 12*c* over the entire circumference, the insertion portion 12*c* of the pinion 12 can be inserted into the hole 11*a* of the gear 11 along the shaft center direction of the pinion 12. With this configuration, the load when the pinion 12 is pressed into the hole 11*a* of the gear 11 does not act on the circumference of the hole 11*a* of the gear 11 made from the brittle material, so that the circumference of the hole 11*a* is prevented from being damaged by the load when the pinion 12 is pressed into the hole 11*a*.

By rotating at least one of the gear 11 and the pinion 12 about the rotation center C with the insertion portion 12*c* being inserted into the hole 11*a*, the insertion portion 12*c* contacts the hole 11*a* at the eight portions, and the gear 11 and the pinion 12 are connected by the contact with the friction force. At this time, although the friction force with the insertion portion 12*c* of the pinion 12 acts on the gear 11, unlike the load when the pinion 12 is pressed into the hole 11*a* of the gear 11, this friction force does not act on the gear 11 in the thickness direction. The gear 11 is thus prevented from being damaged by the friction force.

As the transmission wheel 1 according to the present embodiment is configured by the gear 11 and the pinion 12, and does not use another component for connecting the gear 11 and the pinion 12, the transmission wheel 1 according to the present embodiment does not increase the manufacturing costs.

According to the transmission wheel 1 of the present embodiment, as the distance ra of the insertion portion 12*c*, the distances Ra, Rb of the hole 11*a*, and the angle θ satisfy the above ineuqation ($Rb<ra<Rb/(\cos\theta)<Ra$) where the angle θ is the angle between the line connecting the rotation center C and the center of the tooth bottom 12*d* of the gear-like portion of the insertion portion 12*c* and the line connecting the rotation center C and the portion of the tooth tip 12*f* adjacent to the center of the tooth bottom, the non-contact state of the insertion portion 12*c* and the hole 11*a* over the entire circumference can be obtained and the contact state at the eight portions can be obtained by the rotation about the rotation center C from the non-contact state.

According to the method of manufacturing the transmission wheel 1 of the present embodiment, the gear 11 and the pinion 12 can be connected with a simple step without being damaged. The simple step includes a step of inserting the insertion portion 12*c* of the pinion 12 into the hole 11*a* of the gear 11 with the arrangement illustrated in FIG. 4A, namely, with the arrangement (non-contact state) at the angular position in which the hole 11*a* of the gear 11 is larger than the insertion portion 12*c* of the pinion 12 over the entire circumference about the rotation center C, and then rotating at least one of the gear 11 and the pinion 12 relative to the other of the gear 11 and the pinion 12 about the rotation center C. As the method does not use another component in addition to the gear 11 and the pinion 12, the manufacturing costs are not increased.

It is preferable for the rotation direction from the non-contact state (FIG. 4A) of the hole 11*a* of the gear 11 and the insertion portion 12*c* of the pinion 12 over the entire circumference to the contact state (FIG. 4B) of the hole 11*a* and the insertion portion 12*c* to be the rotation direction corresponding to the direction in which the load acts when another gear is driven. As the load which acts on the transmission wheel 1 when another gear is driven acts in the direction which strengths the contact between the gear 11 and the pinion 12, the gear 11 and the pinion 12 can be firmly connected.

In the transmission wheel 1 according to the present embodiment, as the insertion portion 12*c* is formed by cutting off a portion of the teeth of the gear portion 12*b* of the pinion 12, the manufacturing costs can be lowered compared to a transmission wheel in which an insertion portion having a contour different from that of the gear portion 12*b* is separately formed.

However, the transmission wheel of the present invention is not limited to the transmission wheel in which the insertion portion is formed by cutting off a portion of the teeth as long as the insertion portion is formed to have different distances from the rotation center to the outer edge at the angular positions about the rotation center. The transmission wheel of the present invention may be a transmission wheel in which an insertion portion having different distances from the rotation center at angular positions about the rotation center is formed separately from the gear on the pinion.

MODIFIED EXAMPLE

In the transmission wheel 1 according to the present invention, the insertion portion 12*c* formed in the pinion 12 has the eight teeth 12*e*, and the hole 11*a* formed in the gear 11 has the regular octagon. However, the number of teeth of the gear of the insertion portion in the power transmission body according to the present invention is not limited to eight, and the shape of the hole is not limited to the regular octagon.

Namely, in the transmission wheel 1 according to the present embodiment, the insertion portion 12*c* may contact the hole 11*a* at least at two portions by forming at least two teeth 12*e* of the insertion portion 12*c*.

Figure 5A:
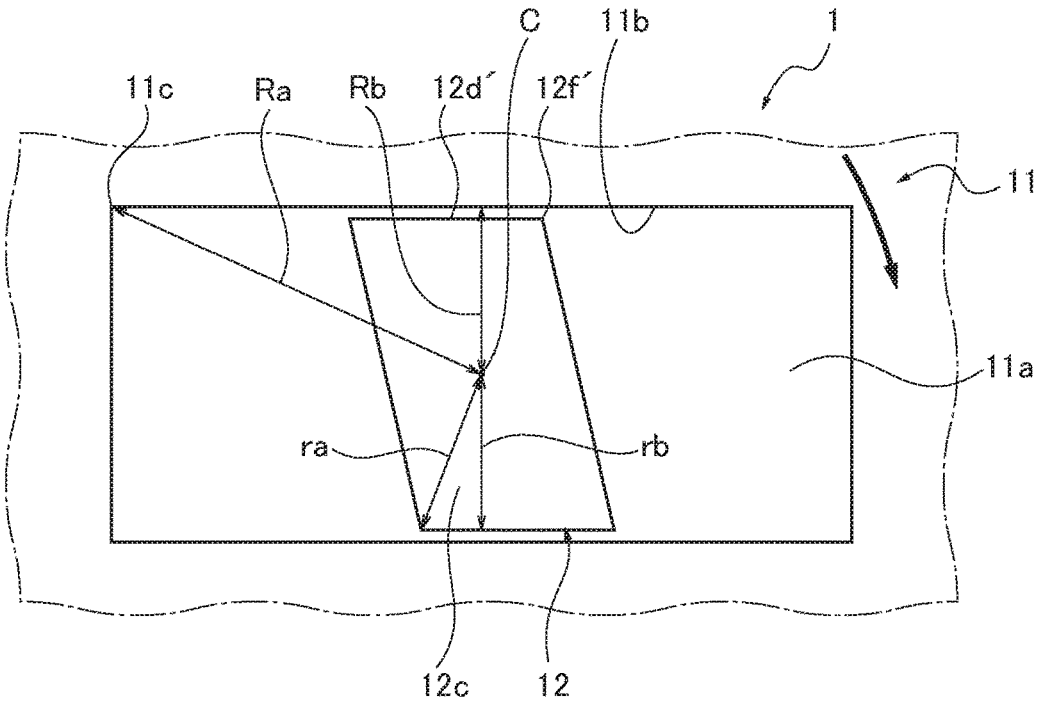
FIG. 5A is a view illustrating a transmission wheel in which a gear and a pinion are connected by the contact between an insertion portion and a hole at two portions, and the parallelogram insertion portion does not contact the rectangular hole over the entire circumference.
Figure 5B:
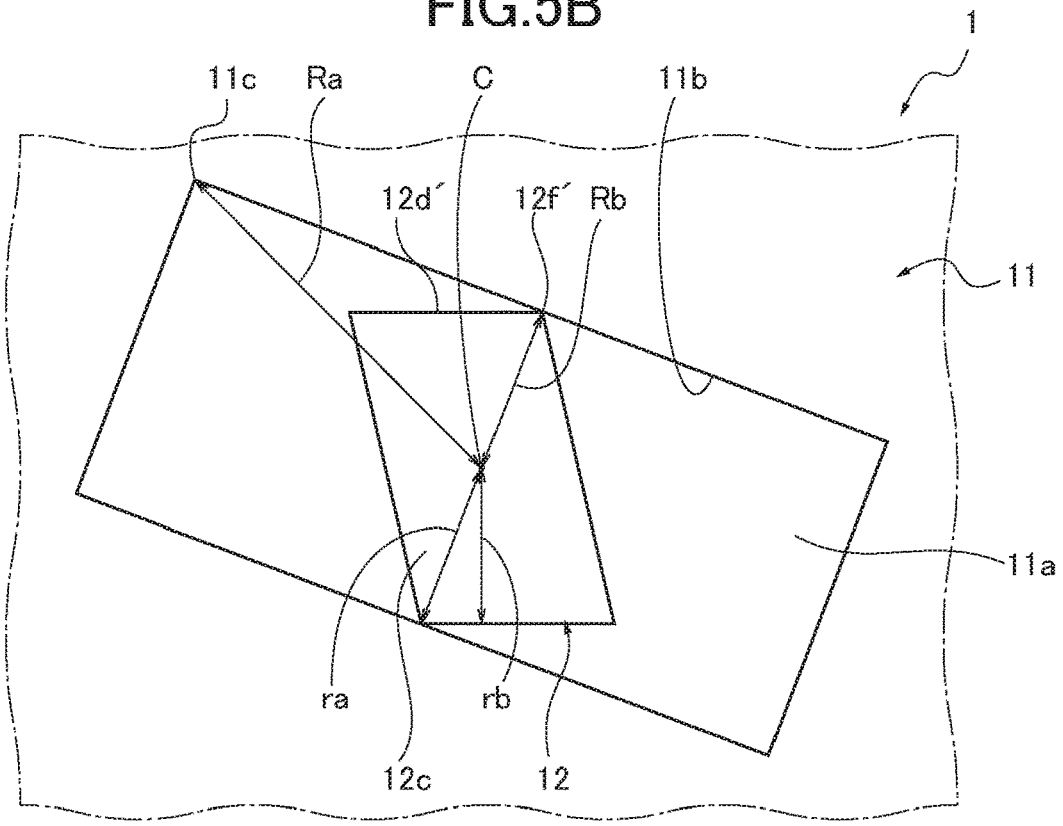
FIG. 5B is a view illustrating the transmission wheel in which the gear and the pinion are connected by the contact between the insertion portion and the hole at two portions, and the insertion portion contacts the hole at two portions.

FIG. 5A is a view illustrating a transmission wheel 1 in which an insertion portion 12*c* contacts a hole 11*a* at two portions to connect a gear 11 and a pinion 12, and the parallelogram insertion portion 12*c* does not contact the rectangular hole 11*a* over the entire circumference. FIG. 5B is a view illustrating the transmission wheel 1 in which the insertion portion 12*c* contacts the hole 11*a* at the two portions to connect the gear 11 and the pinion 12, and the insertion portion 12*c* contacts the hole 11*a* at the two portions.

As illustrated in FIG. 5A, similar to the above embodiment, the parallelogram insertion portion 12*c* includes a portion 12*d*' corresponding to the tooth bottom 12*d* and a portion 12*f* corresponding to the tooth tip 12*f*, and a distance (radius) rb from the rotation center C to the portion 12*d*' differs from a distance (radius) ra from the rotation center C to the portion 12*f*. In this case, these distances have the relationship of the distance ra>the distance rb.

As the hole 11*a* has a rectangular shape with the rotation center C as a center, a distance (radius) Ra from the rotation center C to a vertex 11*c* differs from a distance (radius) Rb from the rotation center C to a side 11*b*. In this case, these distances have the relationship of the distance Ra>the distance Rb.

In the completed transmission wheel 1 (see FIG. 5B) in which the gear 11 rotates in the arrow direction of FIG. 5A, the hole 11*a* includes two portions that are positioned in the circumference direction about the rotation center C and contact the insertion portion 12*c*, and a portion (e.g., vertex 11*c*) that is positioned in front of the two portions in the clockwise direction (specific rotation direction) about the rotation center C and has a distance (e.g., distance Ra) from the rotation center C longer than a distance (distance Rb) from the rotation center C to each of the two portions.

As described above, with the transmission wheel 1 according to the modified example as illustrated in FIGS. 5A and 5B, the operations and the effects similar to those of the transmission wheel 1 illustrated in FIG. 1, for example, can be obtained. However, it is preferable that the insertion portion 12*c* contacts the hole 11*a* at least at three portions by forming at least three teeth 12*e* of the insertion portion 12*c* for stably maintaining the position of the rotation center C with the gear 11 and the pinion 12 being connected.

In the transmission wheel 1 according to the present embodiment, the number of teeth 12*e* of the insertion portion 12*c* is equal to the number of vertexes 11*c* of the regular octagon shape. However, the number of teeth and the number of vertexes in the transmission body of the present invention are not limited to the equal number. In the transmission wheel 1 according to the present embodiment, the number of teeth 12*e* of the insertion portion 12*c* may differ from the number of vertexes 11*c* in the polygon which is the contour of the hole 11*a*.

When the number of teeth differs from the number of vertexes, it is preferable for the number of vertexes 11*c* of the regular polygon which is the contour of the hole 11*a* to be a divisor excluding 1 or a multiple of the number of teeth 12*e* of the insertion portion 12*c*.

Figure 6A:
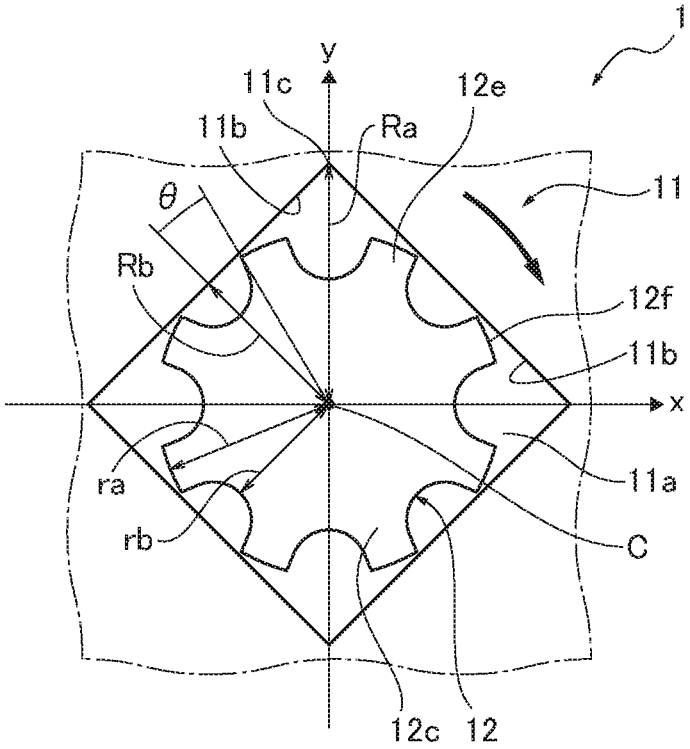
FIG. 6A is a view illustrating a transmission wheel according to an embodiment in which an insertion portion has eight teeth, a contour of a hole has a regular tetragon having four vertexes, four being one of divisors of the number of teeth (eight), and the insertion portion does not contact the hole over the entire circumference.

FIG. 6A is a view illustrating a transmission wheel 1 according to an embodiment in which an insertion portion 12*c* has eight teeth 12*e*, a hole 11*a* has a regular tetragon including four vertexes 11*c*, four being one of the divisors of the number of teeth (eight), and the insertion portion 12*c* does not contact the hole 11*a* over the entire circumference.

Figure 6B:
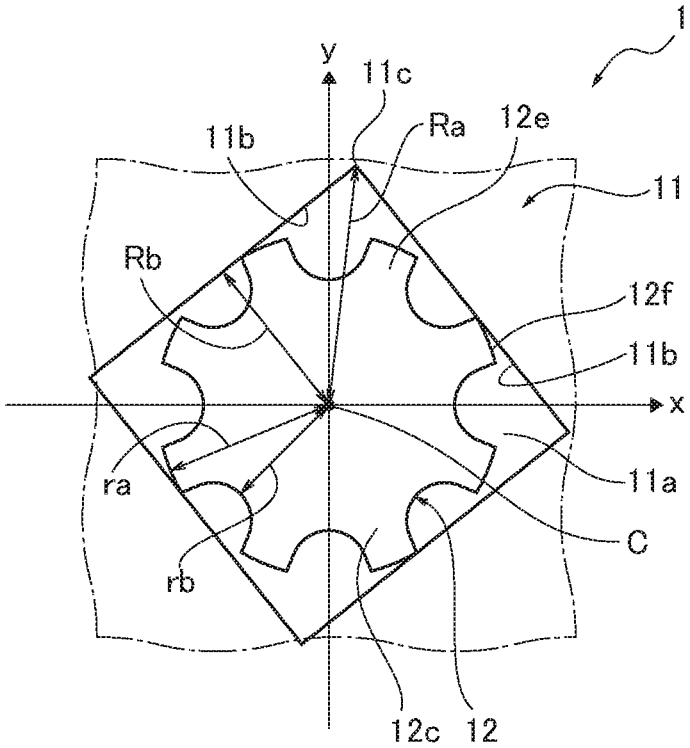
FIG. 6B is a view illustrating the transmission wheel according to the embodiment in which the insertion portion has the eight teeth, the contour of the hole has the regular tetragon having the four vertexes, four being one of divisors of the number of teeth (eight), and the insertion portion contacts the hole at four portions.

FIG. 6B is a view illustrating the transmission wheel 1 according to the embodiment in which the insertion portion 12*c* has the eight teeth 12*e*, the hole 11*a* has the regular tetragon including the four vertexes 11*c*, four being one of the divisors of the number of teeth (eight), and the insertion portion 12*c* contacts the hole 11*a* at four portions, such that toot tips 12*f* (distance ra from rotation center C) contact sides 11*b* (distance Rb from rotation center C).

The operations and the effects similar to those of the transmission wheel 1 illustrated in FIG. 1 can be obtained with the transmission wheel 1 of the embodiment as illustrated in FIGS. 6A and 6B. Namely, in the transmission wheel 1 illustrated in FIGS. 6A and 6B, the hole 11*a* includes four portions that are positioned in the circumference direction about the rotation center C and contact the insertion portion 12*c*, and has a portion that is positioned in front of the four portions in the specific rotation direction about the rotation center C and has a distance Ra from the rotation center C longer than a distance ra from the rotation center C to each of the four portions.

When the insertion portion 12*c* includes twelve teeth 12*e* as a modified example of the present embodiment, the contour of the hole 11*a* can be a regular hexagon having six vertexes, a regular tetragon having four vertexes, or a regular triangle having three vertexes, in addition to a regular dodecagon having twelve vertexes, twelve being one of the divisors of the number of teeth (twelve). The operations and the effects similar to those of the transmission wheel 1 according to each embodiment can be obtained with the transmission wheel according to the modified embodiment in which the number of vertexes of the hole 11*a* is the divisor of the number of teeth as described above.

Figure 7A:
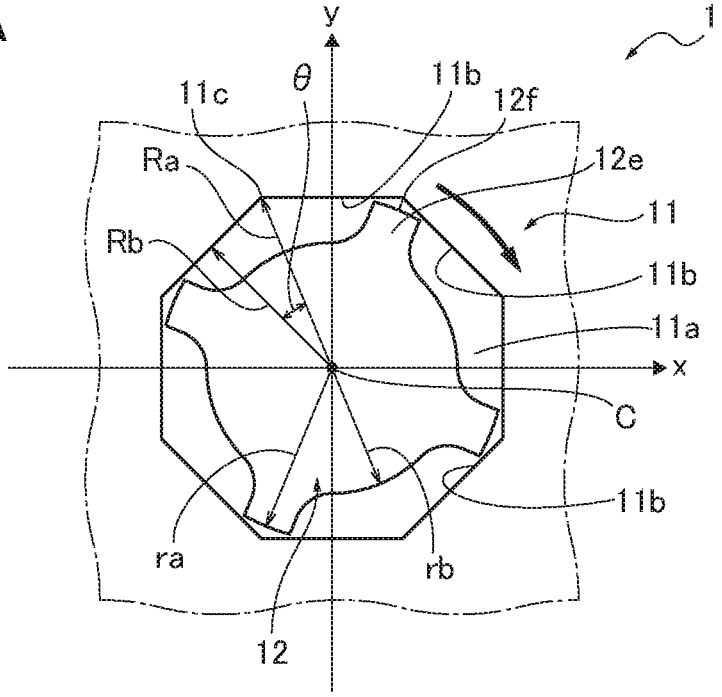
FIG. 7A is a view illustrating a transmission wheel according to an embodiment in which an insertion portion has four teeth, a contour of a hole has a regular octagon having eight vertexes, eight being one of multiples of the number of teeth (four), and the insertion portion does not contact the hole over the entire circumference.
Figure 7B:
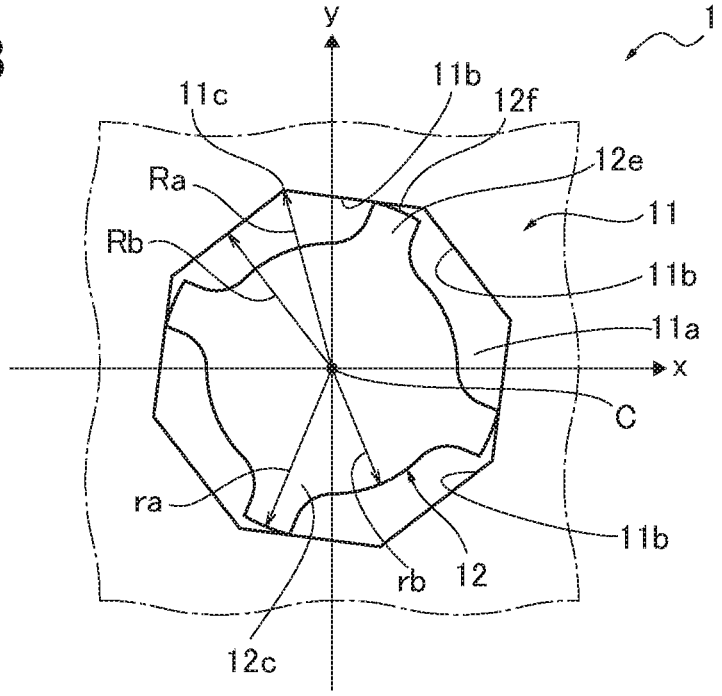
FIG. 7B is a view illustrating the transmission wheel according to the embodiment in which the insertion portion has the four teeth, the contour of the hole has the regular octagon having the eight vertexes, eight being one of multiples of the number of teeth (four), and the insertion portion contacts the hole at eight portions.

FIG. 7A is a view illustrating a transmission wheel 1 according to an embodiment in which an insertion portion 12*c* has four teeth 12*e*, the contour of a hole 11*a* has a regular octagon including eight vertexes 11*c*, eight being one of the multiples of the number of teeth (four), and the insertion portion 12*c* does not contact the hole 11*a* over the entire circumference. FIG. 7B is a view illustrating the transmission wheel 1 according to the embodiment in which the insertion portion 12*c* has the four teeth 12*e*, the contour of the hole 11*a* has the regular octagon including the eight vertexes 11*c*, eight being one of the multiples of the number of teeth (four), and the insertion portion 12*c* contacts the hole 11*a* at the four portions to bring the tooth tips 12*f* (distance ra from rotation center C) into contact with the sides 11*b* (distance Rb from rotation center C).

The operation and effects similar to those of the transmission wheel 1 illustrated in FIG. 1, for example, can be obtained with the transmission wheel 1 of the embodiment illustrated in FIGS. 7A and 7B. Namely, in the transmission wheel 1 illustrated in FIGS. 7A and 7B, the hole 11*a* includes four portions that are positioned in the circumference direction about the rotation center C and contact the insertion portion 12*c*, and a portion that is positioned in front of the four portions in the specific rotation direction about the rotation center C and has a distance Ra from the rotation center C longer than the distance ra from the rotation center C to each of the four portions.

When the insertion portion 12*c* includes six teeth 12*e* as a modified example of the present embodiment, the contour of the hole 11*a* may be a regular octadecagon having eighteen vertexes or a regular icositetragon having twenty four vertexes, except a regular dodecagon having twelve vertexes, twelve being one of the multiples of the number of teeth (six). The operations and effects similar to those of the transmission wheel 1 of each embodiment can be obtained with the transmission wheel of the modified example in which the number of vertexes of the hole 11*a* is the multiple of the number of teeth.

Figure 8:
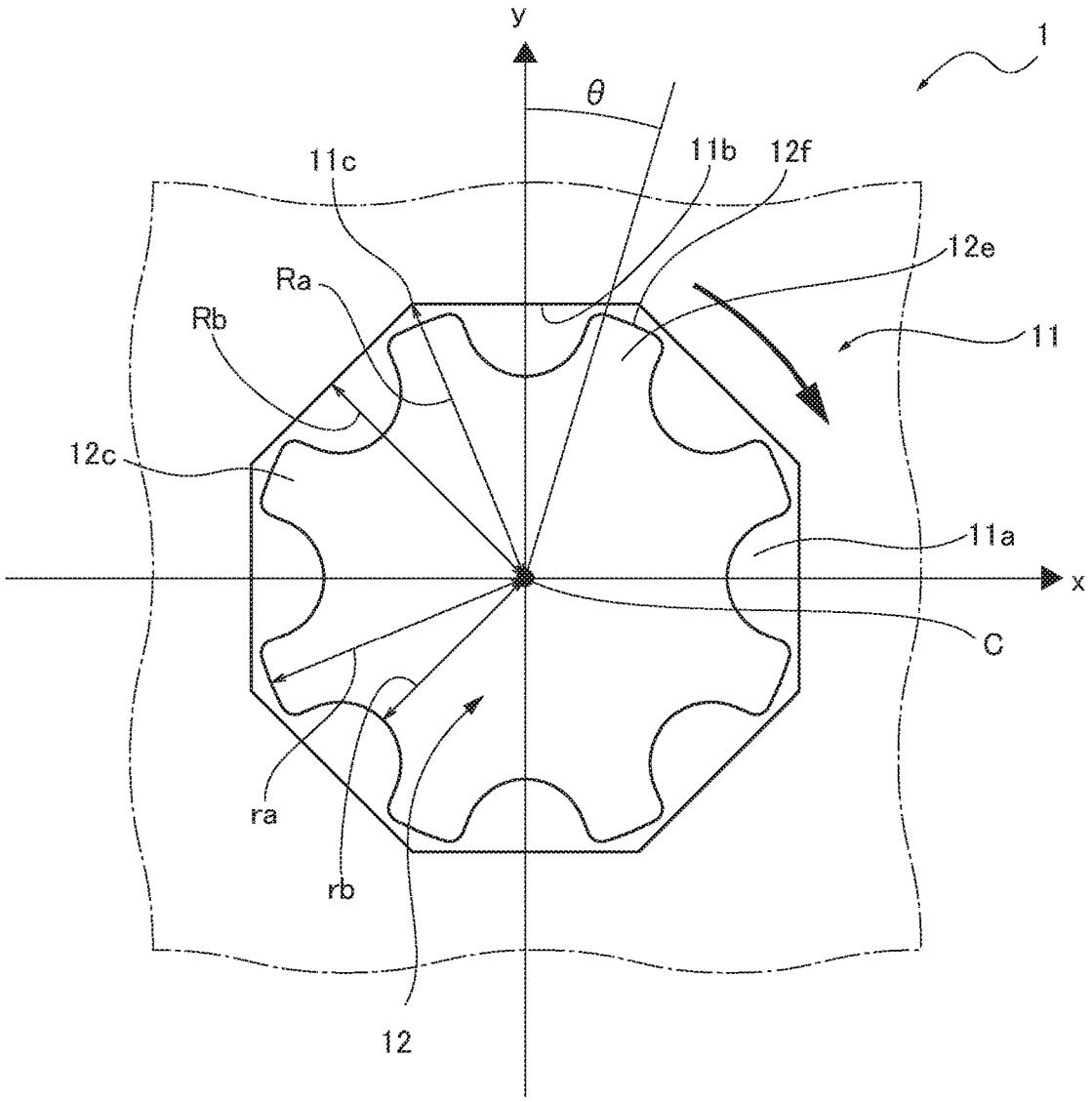
FIG. 8 is a plan view corresponding to FIG. 4, illustrating a modified example in which corners of the teeth of the insertion portion in the transmission wheel illustrated in FIG. 4 have curved surfaces, respectively.

FIG. 8 is a plan view corresponding to FIG. 4, illustrating a modified example in which corners of the teeth 12*e* of the insertion portion 12*c* in the transmission wheel 1 illustrated in FIG. 4 include curved surfaces. In the transmission wheels 1 according to the above embodiments, the corners of the tooth tips 12*f* of the teeth 12*e* of the insertion portion 12*c* may be formed with curved surfaces (R shape) as illustrated in FIG. 8. The operations and effects similar to those of the transmission wheel 1 of the above embodiments can be obtained with the transmission wheel 1 in this modified example. Moreover, in this modified example, the pinion 12 contacts the gear 11 with the curved surfaces (R shape) when both the gear 11 and the pinion 12 are fixed with the relative rotation. Therefore, the load can smoothly act on the transmission wheel 1.

Figure 9A:
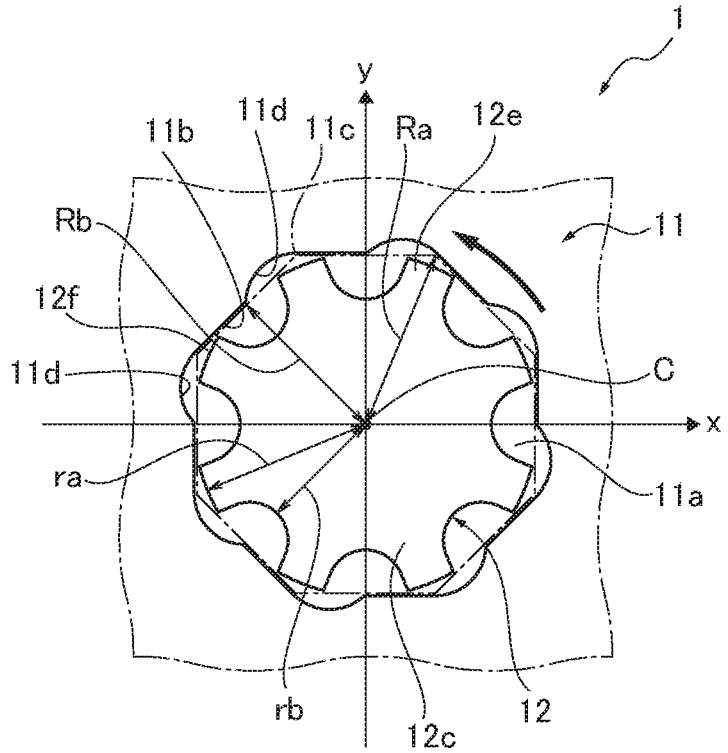
FIG. 9A is a view illustrating a transmission wheel according to an embodiment in which an insertion portion has eight teeth, a hole has a contour obtained by cutting off each vertex and the vicinity portion thereof of a regular octagon, and the insertion portion does not contact the hole over the entire circumference.
Figure 9B:
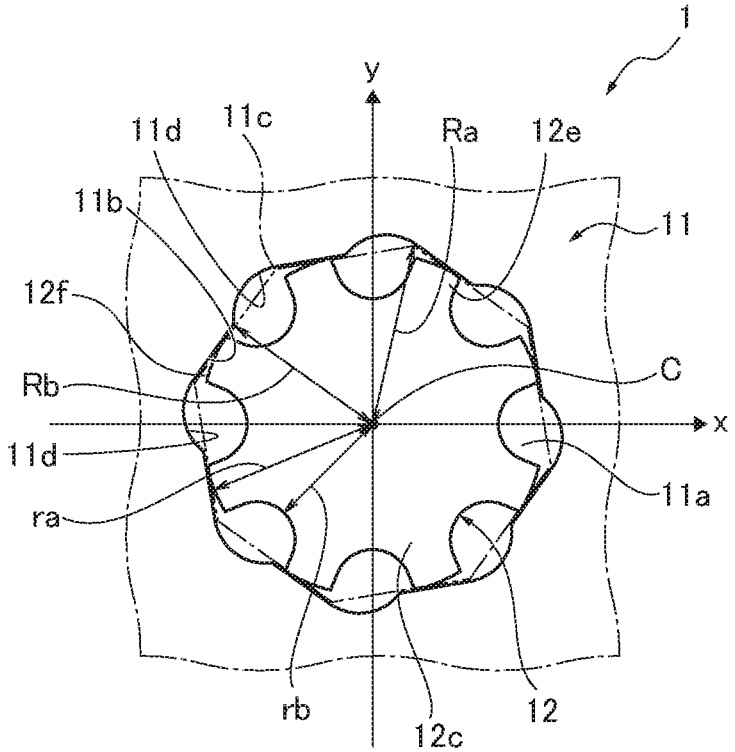
FIG. 9B is a view illustrating the transmission wheel according to the embodiment in which the insertion portion has the eight teeth, the hole has the contour obtained by cutting off each vertex and the vicinity portion thereof of the regular octagon, and the insertion portion contacts the hole at four portions.

FIG. 9A is a view illustrating a transmission wheel 1 according to an embodiment in which an insertion portion 12*c* includes eight teeth 12*e*, a hole 11*a* has a contour, and the insertion portion 12*c* does not contact the hole 11*a* over the entire circumference. In the contour, each vertex 11*c* and the vicinity portion of the each vertex of the regular octagon are cut off. FIG. 9B is a view illustrating the transmission wheel 1 according to the embodiment in which the insertion portion 12*c* includes the eight teeth 12*e*, the hole 11*a* has the contour, and the insertion portion 12*c* contacts the hole 11*a* at the eight portions. In the contour of the hole 11*a*, each vertex 11*c* and the vicinity portion thereof of the regular octagon are cut off The regular polygon holes formed in the gear in the power transmission wheel of the timepiece according to the present invention includes a contour in which a portion of the regular polygon (the portion where the insertion portion of the pinion does not contact) is cut off as illustrated in FIGS. 9A and 9B, in addition to the contour of the true regular polygon (the regular octagon in the example illustrated in FIGS. 4A and 4B).

In FIGS. 9A and 9B, the hole 11*a* includes eight portions that are positioned in the circumference direction about the rotation center C and contact the insertion portion, and a portion that is positioned in front of the eight portions and has the distance Ra from the rotation center C longer than the distance ra from the rotation center C to each of the eight portions.

In the transmission wheel 1 illustrated in FIGS. 9A and 9B, the gear 11 includes the hole 11*a* having a contour in which each vertex 11*c* and the vicinity portion thereof of the regular octagon (illustrated by dashed line) are cut off by a curved line. As a result, the hole 11*a* includes the polygon contour formed by the combination of a portion of the side 11*b* and the circular arc side 11*d* of the regular octagon, and does not have a true regular octagon contour.

However, each cut off vertex 11*c* and the vicinity portion thereof are portions where the insertion portion 12*c* of the pinion 12 does not contact as illustrated in FIG. 9B even if the these portions are not cut off. Namely, a portion of the hole 11*a* of the gear 11 of the transmission wheel 1 where the tooth tip 12*f* of the insertion portion 12*c* of the pinion 12 contacts is a portion of the side 11*b* of the regular octagon.

As described above, as the side 11*b* of the hole 11*a* where the tooth tip 12*f* of the insertion portion 12*c* of the pinion 12 contacts configures the side of the regular octagon even if the contour of the hole 11*a* is not the regular octagon as the whole as illustrated in FIG. 7, such a hole 11*a* substantially includes the contour of the regular octagon.

In the power transmission body of the present invention, the regular polygon as the shape of the hole of the power transmission member includes not only a true regular polygon but also a shape in which a portion of the hole where an insertion portion of an arbor substantially contacts corresponds to a portion of the regular polygon.

In the transmission wheel 1 illustrated in FIGS. 9A and 9B, a portion of the vertex 11*c* and a portion of the side 11*b* of the regular octagon are cut off, and the hole 11*a* extends outside the side 11*d* compared to the true regular octagon. Thus, the space between the insertion portion 12*c* and the hole 11*a* with the non-contact state is increased. The insertion portion 12*c* of the pinion 12 can be thereby inserted into the hole 11*a* of the gear 11 with the non-contact state easier than when the insertion portion 12*c* of the pinion 12 is inserted into the hole 11*a* (refer to FIG. 4) of the true regular polygon.

Figure 10:
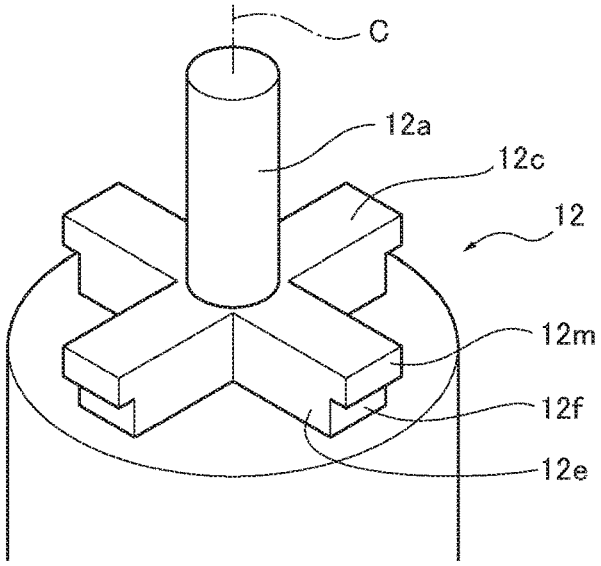
FIG. 10 is a perspective view illustrating an example in which a flange projecting outside a tooth tip in the radial direction is formed in each tooth of an insertion portion of a pinion.
Figure 11A:
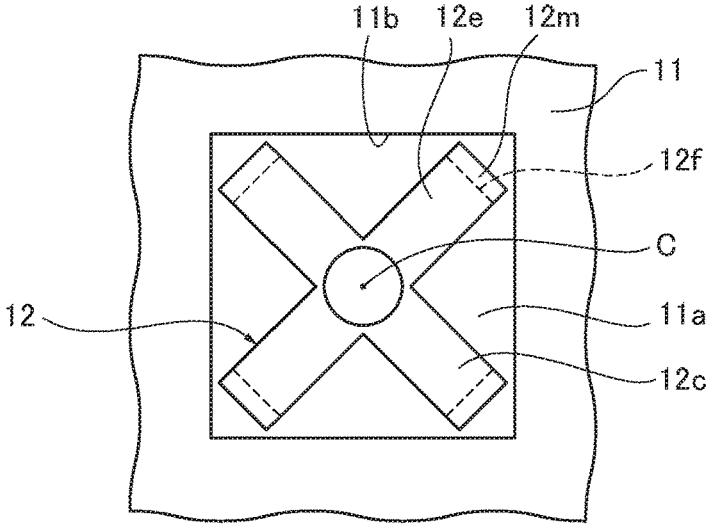
FIG. 11A is a plan view illustrating a gear in which a portion of the tooth tip of the insertion portion in FIG. 10 is inserted into a hole of the gear, and the tooth tip does not contact a side of the hole.
Figure 11B:
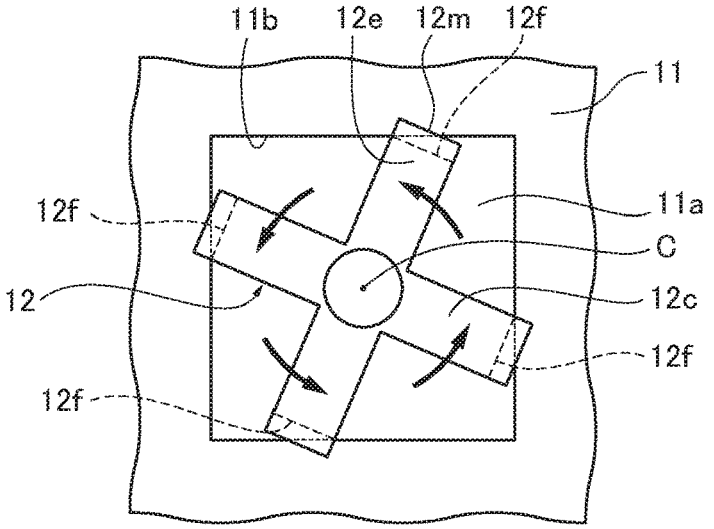
FIG. 11B is a plan view illustrating the gear in which a portion of the tooth tip of the insertion portion in FIG. 10 is inserted into the hole of the gear, and the tooth tip contacts the side of the hole by the rotation of the pinion in the counterclockwise direction (arrow direction).
Figure 12:
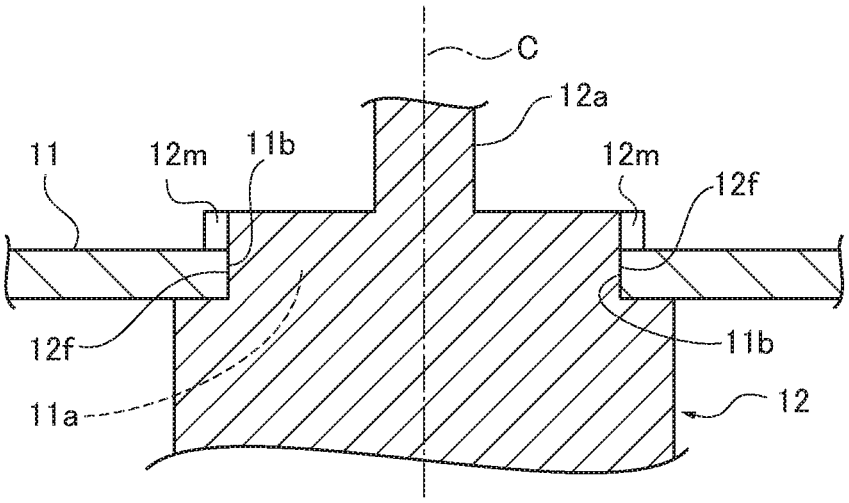
FIG. 12 is a sectional view along a rotation center C in FIG. 11.

FIG. 10 is a perspective view illustrating an example in which a flange 12*m* projecting outside a tooth tip 12*f* in the radial direction is formed in each tooth 12*e* of an insertion portion 12*c* of a pinion 12. FIG. 11A is a plan view illustrating a hole 11*a* of a gear 11 into which a portion of the tooth tip 12*f* of the insertion portion 12*c* illustrated in FIG. 10 is inserted, and the tooth tip 12*f* which does not contact a side 11*b* of the hole 11*a*. FIG. 11B is a plan view illustrating the hole 11*a* of the gear 11 into which a portion of the tooth tip 12*f* of the insertion portion 12*c* illustrated in FIG. 10 is inserted, and the tooth tip 12*f* which contacts the side 11*b* by the counterclockwise rotation (arrow direction) of the pinion 12. FIG. 12 is a sectional view along the rotation center C in FIGS. 11A, 11B.

As illustrated in FIG. 10, the flange 12*m* projecting outside the tooth tip 12*f* of the tooth 12*e* may be formed in the insertion portion 12*c* of the pinion 12. As illustrated in FIG. 11A, the flange 12*m* is formed to pass through the hole 11*a* of the gear 11 in the axis direction at a position of a specific rotation angle about the rotation center C.

On the other hand, as illustrated in FIG. 11B, when the pinion 12 rotates about the rotation center C in the counterclockwise direction with the thickness portion of the tooth tip 12*f* of the insertion portion 12*c* being inserted into the hole 11*a*, the tooth tip 12*f* contacts the side of the hole 11*a*, and the insertion portion 12*c* is fixed to the hole 11*a*. Moreover, as illustrated in FIG. 12, as the flange 12*m* formed adjacent to the tooth tip 12*f* of the tooth 12*e* in the axis direction projects outside the hole 11*a* of the gear in the radial direction, the flange 12*m* is used as a retaining member in axis direction. Therefore, the pinion 12 and the gear 11 can be reliably prevented from disconnecting in the axis direction.

In the power transmission body of the timepiece according to the present invention, the insertion portion formed in the arbor does not contact the hole formed in the power transmission member over the entire circumference, and the insertion portion contacts the hole at least at two portions by the rotation about the rotation center from the non-contact state. The present invention is not limited to the above embodiments as long as it achieves these configurations.

In the above embodiments and the modified examples, the transmission wheel 1 that sequentially transmits the power of wheels of the wheel train such as the second wheel, the third wheel, the fourth wheel, and the escape wheel is applied as one example of the power transmission body of the timepiece according to the present invention. However, the power transmission body of the timepiece according to the present invention may include a power transmission body by combination of an arbor except a pinion such as an anchor striker, a balance, a ratchet wheel, and a balance spring and a power transmission member except a gear.

Figure 13:
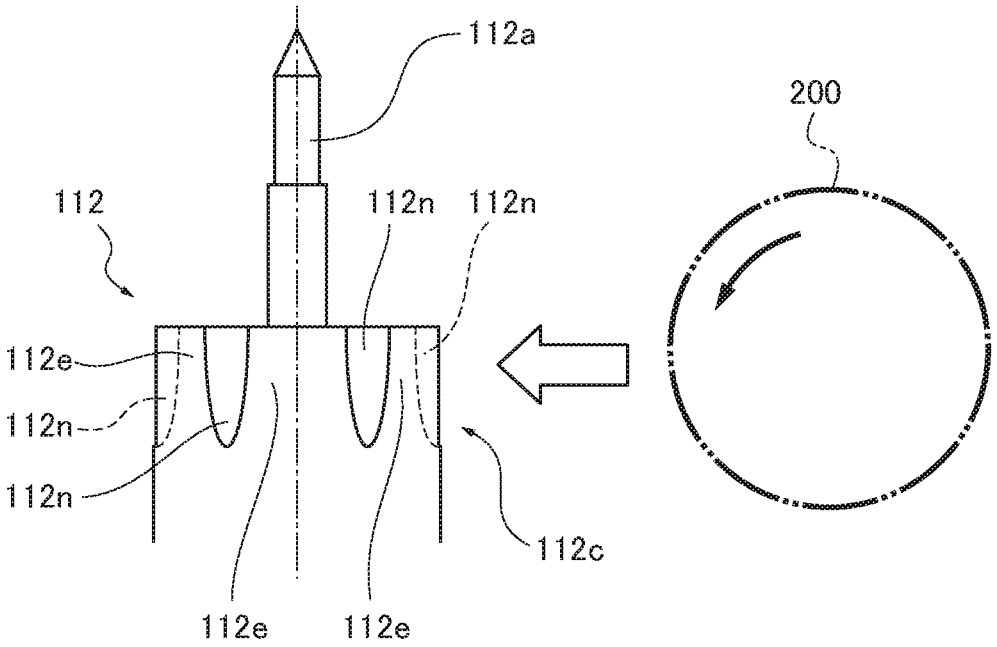
FIG. 13 is a side view of an arbor that is combined with the hole of the above gear as one example of the arbor which configures the power transmission body.

FIG. 13 is a side view of an arbor 112 which is combined with the hole 11*a* of the above gear 11 as one example of an arbor configuring the power transmission body. In the arbor 112, a tooth 112*e* corresponding to the tooth 12*e* of the pinion 12 in the above embodiments and the modified examples is formed in an insertion portion 112*c* except the tenon 112*a*. Even when the tooth 112*e* is directly formed in the arbor 112 without using the pinion 12 as described above, the gear 11 to be combined with the hole 11*a* of the gear 11 can be fixed similar to the embodiments and the modified examples.

The tooth 112*e* can be formed by a gear cutting tool 200 which has a circular plate shape and rotates in the two-dot dashed line in FIG. 13. More specifically, the gear cutting tool 200 moves in the arrow direction in the figure toward the cylindrical arbor 112 before the tooth 112*e* is formed, the arbor 112 is cut off by pressing the tool 200 to the circumference surface of the arbor 112, and a plurality of grooves 112*n* is formed in the circumference surface of the arbor 112. A left portion between these grooves 112*n* can be thereby used as the tooth 112*e*.

What is claimed is:

1. A power transmission body of a timepiece, comprising:

a power transmission member provided with a hole in a center portion of the power transmission member, the hole having distances from a rotation center to an inner edge, and the distances being different in accordance with angular positions about the rotation center; and an arbor including an insertion portion fitted into the hole, the insertion portion having distances from the rotation center to an outer edge, and the distances being different in accordance with angular positions about the rotation center, wherein the hole includes at least two portions that are positioned in a circumferential direction about the rotation center and contact the insertion portion, and a portion that is positioned in front of the two portions in a specific rotation direction about the rotation center and has a distance from the rotation center longer than a distance from the rotation center to each of the two portions, the insertion portion is a gear-like portion having a distance ra from the rotation center to an outermost projecting edge, the hole has distances Ra, Rb from the rotation center to the inner edge, the distance Ra being different from the distance Rb, and the distance ra, the distances Ra, Rb of the hole, and an angle θ satisfy a following inequation where the angle θ is an angle between a line connecting the rotation center and a center of a tooth bottom of a tooth of the gear-like portion and a line connecting the rotation center and the outermost projecting edge:

$$Rb<ra<Rb/(\cos\theta)\leq Ra.$$

2. The power transmission body of a timepiece according to claim 1, wherein the hole includes vertexes, the number of the vertexes is a divisor of the number of teeth of the gear-like portion of the insertion portion excluding one, and the hole is a regular polygon including an inscribed circle having a radius from the rotation center as the distance Rb.

3. The power transmission body of a timepiece according to claim 1, wherein the hole includes vertexes, the number of the vertexes is a multiple of the number of teeth of the gear-like portion of the insertion portion, and the hole is a regular polygon including an inscribed circle having a radius from the rotation center as the distance Rb.

4. The power transmission body of a timepiece according to claim 1, wherein the gear-like portion of the insertion portion has a same sectional shape as a portion of a gear formed in the arbor from the rotation center to the distance ra.

5. The power transmission body of a timepiece according to claim 1, wherein an adhesive agent is applied to contact portions between the insertion portion and the hole.

6. The power transmission body of a timepiece according to claim 1, wherein the power transmission member is made from a brittle material.

7. A method of manufacturing a power transmission body of a timepiece, for connecting an arbor and a power transmission member, the arbor including an insertion portion having distances from a rotation center to an outer edge, the distances being different in accordance with angular positions about the rotation center, the power transmission member including a hole having a contour, the hole being larger than the insertion portion at a specific angular position about the rotation center, and the contour including at least two portions having a distance shorter than a maximum distance of the insertion portion at angular positions different from the specific angular position, the method comprising:

inserting the insertion portion in the hole at the specific angular position; and connecting the power transmission member and the arbor by rotating at least one of the power transmission member and the arbor relative to the other of the power transmission member and the arbor such that the insertion portion contacts the hole at the two portions.

* * * * *